US008715095B2

(12) United States Patent
Hsieh

(10) Patent No.: US 8,715,095 B2
(45) Date of Patent: May 6, 2014

(54) OUTDOOR PLAYGROUND WITH SHADING APPARATUS

(76) Inventor: Paul Hsieh, City of Industry, CA (US)

( * ) Notice: Subject to any disclaimer, the term of this patent is extended or adjusted under 35 U.S.C. 154(b) by 183 days.

(21) Appl. No.: 13/317,419

(22) Filed: Oct. 17, 2011

(65) Prior Publication Data

US 2013/0095937 A1 Apr. 18, 2013

(51) Int. Cl.
*A63G 21/18* (2006.01)
*A63G 9/00* (2006.01)

(52) U.S. Cl.
USPC ..... 472/116; 472/118

(58) Field of Classification Search
CPC ..... A63B 9/00; A63B 9/12; A63B 21/00; A63B 21/18; A63B 31/00; A63B 2208/12
USPC ..... 472/118–125; 482/24, 35, 36
See application file for complete search history.

(56) References Cited

U.S. PATENT DOCUMENTS

| | | | | |
|---|---|---|---|---|
| 814,156 | A * | 3/1906 | McKnight | 472/20 |
| 2,097,905 | A * | 11/1937 | Weaver | 297/245 |
| 2,977,118 | A * | 3/1961 | Farkas | 482/35 |
| 3,503,582 | A * | 3/1970 | Boucher | 248/370 |
| 4,256,300 | A * | 3/1981 | Boucher | 472/118 |
| 6,383,085 | B1 * | 5/2002 | Tseng | 472/118 |
| 7,909,738 | B2 * | 3/2011 | Chen | 482/27 |

* cited by examiner

*Primary Examiner* — Kien Nguyen
(74) *Attorney, Agent, or Firm* — Raymond Y. Chan; David and Raymond Patent Firm

(57) ABSTRACT

An outdoor playground includes a first and a second entertainment units connected with each other. The first entertainment unit includes a first utility frame configured to allow a predetermine entertainment function to be carried out by the first utility frame and a first shading apparatus detachably mounted on the first utility frame for effectively shielding the first utility frame. The second entertainment unit includes a second utility frame configured to allow a predetermine entertainment function to be carried out by the second utility frame, and a second shading apparatus detachably mounted on the second utility frame for effectively shielding the second utility frame so as to allow the entertainment function to be carried out under shading.

13 Claims, 11 Drawing Sheets

OUTDOOR PLAYGROUND WITH SHADING APPARATUS

BACKGROUND OF THE PRESENT INVENTION

1. Field of Invention

The present invention relates to a playground, and more particularly to an outdoor playground with a plurality of shading apparatuses which is capable of providing effective shading to a plurality of entertainment units so that users may be able to carry out predetermined entertainment functions under substantial shading.

2. Description of Related Arts

A conventional playground may include a plurality of entertainment units each performing different entertainment functions. For example, a particular playground may be equipped with a slide, a swing, a plurality of benches, and many more. Each of these entertainment units is spacedly positioned from each other and the entire playground may accommodate a predetermined number of users (such as a predetermined number of children) so that at any particular time, a certain number of people is playing on the entertainment units at the same time.

Conventionally however, most entertainment units in the playground are directly exposed to sunlight and there is no shield or shading of any kind to the entertainment units. Thus, people playing on the entertainment units may be subject to severe sunlight exposure which may affect their health. This consequence is especially bad for children, who are easily attracted by the entertainment units, and the strong sunlight may impart substantial burning on their skin.

Moreover, most entertainment units in conventional playground require complicated procedures for assembling. Many of the entertainment units are made by metallic or even concrete materials. As a result, most entertainment units are not easily detachable or disassembled. This prohibits widespread installation of entertainment units or the playground.

Furthermore, each of the entertainment units is a standalone structure which is structurally independent form each other. As a result, conventional playground is nothing more than an aggregate of a plurality of entertainment units positioned in the vicinity of each other. Little benefit will accrue to the playground from having such accretions of the entertainment units.

SUMMARY OF THE PRESENT INVENTION

The invention is advantageous in that it provides an outdoor playground with a plurality of shading apparatuses which is capable of providing effective shading to a plurality of entertainment units so that users may be able to carry out predetermined entertainment functions under substantial shading.

Another advantage of the invention is to provide an outdoor playground comprising a plurality of entertainment units, wherein each of the entertainment units are structurally connected with at least an adjacent entertainment unit so as to form an integral entertainment structure for the outdoor playground.

Another advantage of the invention is to provide an outdoor playground comprising a plurality of entertainment units, wherein each of the entertainment units comprises a utility frame and a shading frame for providing effective shading to the people using the utility frame. Note that the shading frame can be conveniently assembled on the utility frame, and it can also be easily disassembled from the utility frame.

Another advantage of the invention is to provide an outdoor playground comprising a plurality of entertainment units, wherein each of the entertainment units may be embodied as performing different entertainment activities so as to allow the playground to support a wide variety of activities.

Additional advantages and features of the invention will become apparent from the description which follows, and may be realized by means of the instrumentalities and combinations particular point out in the appended claims.

According to the present invention, the foregoing and other objects and advantages are attained by providing an outdoor playground, comprising:

a first and a second entertainment units connected with each other, wherein the first entertainment unit comprises:

a first utility frame configured to allow a predetermine entertainment function to be carried out by the first utility frame; and a first shading apparatus detachably mounted on the first utility frame for effectively shielding the first utility frame so as to allow the entertainment function to be carried out under shading, wherein the second entertainment unit comprises:

a second utility frame configured to allow a predetermine entertainment function to be carried out by the second utility frame; and a second shading apparatus detachably mounted on the second utility frame for effectively shielding the second utility frame so as to allow the entertainment function to be carried out under shading, whereby the first and the second entertainment units are arranged to act as entertainment facilities as outdoor playground to users who are substantially shaded from sunlight by the first and the second shading frame Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
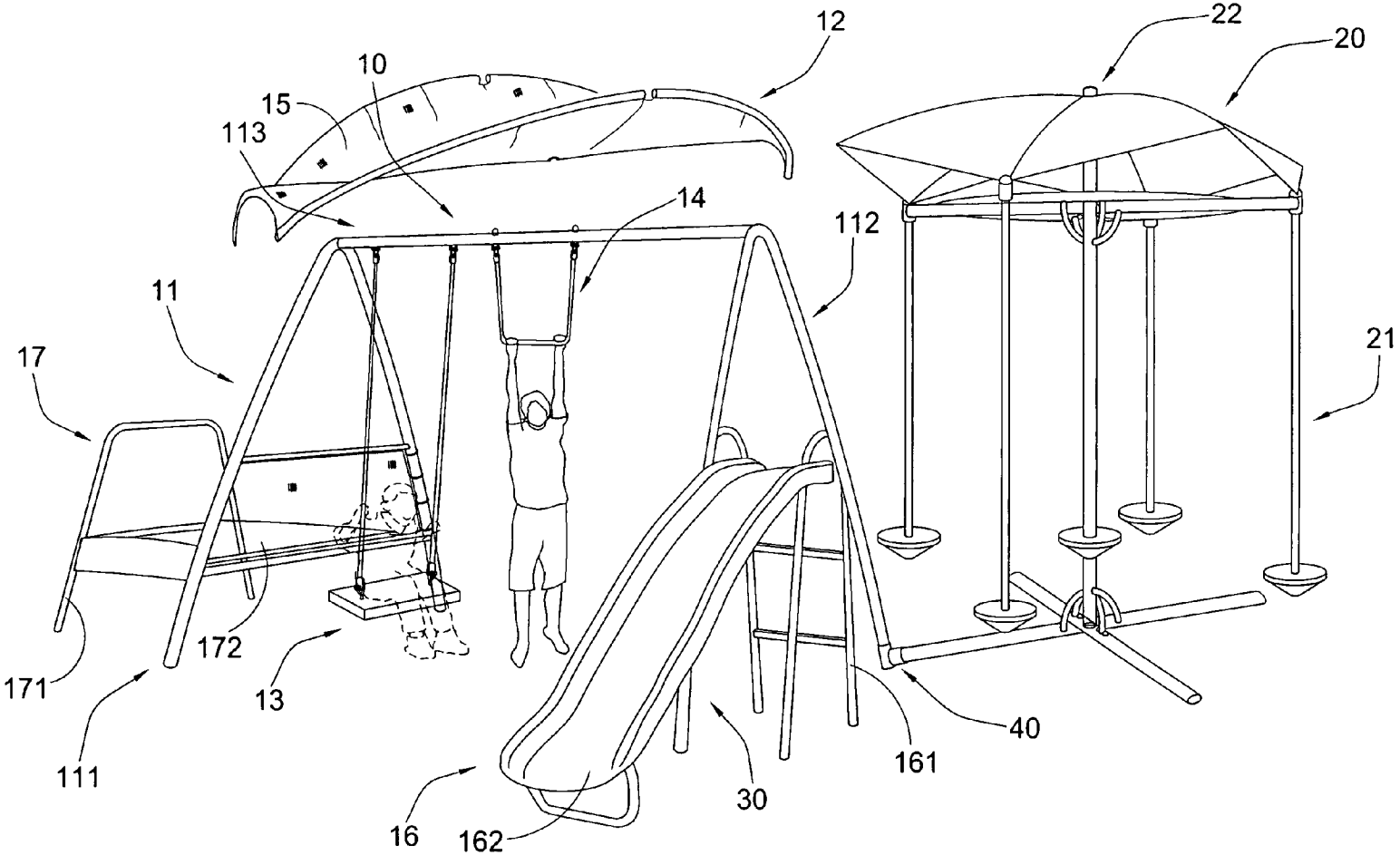
FIG. 1 is a perspective view of a playground according to a preferred embodiment of the present invention.

Referring to FIG. 1, FIG. 2A, FIG. 2B, FIG. 3 to FIG. 10 of the drawings, an outdoor playground according to a preferred embodiment of the present invention is illustrated, in which the outdoor playground comprises a plurality of entertainment units, such as a first entertainment unit 10, a second entertainment unit 20, and a third entertainment unit 30.

The first and the second entertainment units 10, 20 are connected with each other, wherein the first entertainment unit comprises a first utility frame 11 and a first shading apparatus 12. The first utility frame 11 is configured to allow a predetermine entertainment function to be carried out by the first utility frame 11, whereas the first shading apparatus 12 is detachably mounted on the first utility frame 11 for effectively shielding the first utility frame 11 so as to allow the entertainment function to be carried out under shading.

On the other hand, the second entertainment unit 20 comprises a second utility frame 21 and a second shading apparatus 22. The second utility frame 21 is configured to allow a predetermine entertainment function to be carried out by the second utility frame 21, whereas the second shading apparatus 22 is detachably mounted on the second utility frame 21 for effectively shielding the second utility frame 21 so as to allow the entertainment function to be carried out under shading. Thus, the first and the second entertainment units 10, 20 are arranged to act as entertainment facilities as outdoor playground to users who are substantially shaded from sunlight by the first and the second shading frame 12, 22.

According to the preferred embodiment of the present invention, the first entertainment unit 10 is preferably configured to support a swing 13 and a training bar 14 so that users may be able to use the swing 13 and the training bar 14 as entertaining activities.

The first utility frame 11 comprises a first and a second leg frame 111, 112 and a supporting bar 113 extended between the first and the second leg frame 111, 112, wherein the first utility frame 11 has a first and a second mounting slot 1111, 1112, while the second utility frame 12 has a third and a fourth mounting slot 1121, 1122.

The first shading apparatus 12 comprises a first and the second coupling joints 121, 122 each has a V-shaped cross section and is detachably coupled with two ends of the supporting bar 113 respectively, wherein the first and the second mounting slot 1111, 1112 are formed on the first coupling joint 121, while the third and the fourth mounting slot 1121, 1122 are formed on the second coupling joint 122.

The first shading apparatus 12 further comprises a first frame member 123 having two ends 1231, 1232 detachably coupled with the first and the third mounting slot 1111, 1121 of the first leg frame 111 and the second leg frame 112 respectively, and a second frame member 124 having two ends 1241, 1242 detachably coupled with the second mounting slot and the fourth mounting slot 1112, 1122 of the first and the second leg frame 111, 112 respectively.

The first shading apparatus 12 further comprises a reinforcing frame 125 extended between the first and second frame member 123, 124 and the supporting bar 14 to form a support platform by the first and second frame member 123, 124 and the reinforcing frame 125, wherein the first entertainment unit 10 further comprises a first shading fabric 15 detachably mounted on the support platform for shading adverse weather condition in an area underneath the shading fabric 15.

The first leg frame 111 comprises a plurality of first legs 1113 inclinedly extended from the ground surface toward the supporting bar 113, wherein the first coupling joint 121 is mounted between the supporting bar 113 and the first legs 1113. Moreover, the first and the second mounting slot 1111, 1112 are formed on the first legs 1113 respectively.

On the other hand, the second leg fame 112 comprises a plurality of second legs 1123 inclinedly extended from the ground surface toward the supporting bar 113, wherein the second coupling joint 122 is mounted between the supporting bar 113 and the second legs 1123. Moreover, the third and the fourth mounting slot 1121, 1122 are formed on the second legs 1123 respectively.

The first coupling joint 121 of the first shading apparatus 12 preferably has a first joint body 1211 and a second joint body 1212 inclinedly extended from the corresponding end of the supporting bar 113 to form a V-shaped cross section, wherein the first coupling joint 121 further has a first and a second connecting slot 1213, 1214 formed on the first and the second joint body 1211, 1212 respectively. Similarly, the second coupling joint 122 of the first shading apparatus 12 also has a third and a fourth joint body 1221, 1222 inclinedly extended from the corresponding end of the supporting bar 113 to also form a V-shaped cross section, wherein the second coupling joint 122 further has a third and a fourth connecting slot 1223, 1224 formed on the third and the fourth joint body 1221, 1222 respectively.

It is worth mentioning that each of the first through second joint body 1211, 1212, connect the first legs 1113 with the corresponding end of the supporting bar 113 while the third through fourth joint body 1221, 1222 connect the second legs 1123 to the corresponding end of the supporting bar 113 in this preferred embodiment. However, as a slight alternative, the V-shaped structure of the first and the second coupling joint 1211, 1212 can detachably ride on the two end portions of the supporting bar 113 respectively so as to connect the supporting bar 113 with the first and the second leg frames 111, 112.

Each of the first and the second frame member 123, 124 is elongated in shape and is made of strong yet slightly flexible materials (preferably bendable) for supporting the first shading fabric 15. Moreover, each of the first and the second frame member 123, 124 is curved in shape so that when they are mounted on the first and the second leg frames 111, 112, they form a slightly concave structure for supporting the first shading fabric 15 in a corresponding shape. In other words, the first shading fabric 15 is supported in such a manner that it is arranged to form a concave structure for the sun shading apparatus.

The first frame member 123 further has a plurality of first connectors 1233 formed at two ends 1231, 1232 thereof, wherein the first connectors 1233 are arranged to detachably inserted into the first mounting slot 1111 and the third mounting slot 1121 respectively so as to extend across the first leg frame 111 and the second leg frame 112 in a longitudinal direction of the first entertainment unit 10. On the other hand, the second frame member 124 has a plurality of second connectors 1243 formed at two ends 1241, 1242 thereof, wherein the second connectors 1243 are arranged to detachably inserted into the second mounting slot 1112 and the fourth mounting slot 1122 respectively so as to extend across the first leg frame 111 and the second leg frame 112 in a similar manner as that of the first frame member 123.

Figure 6:
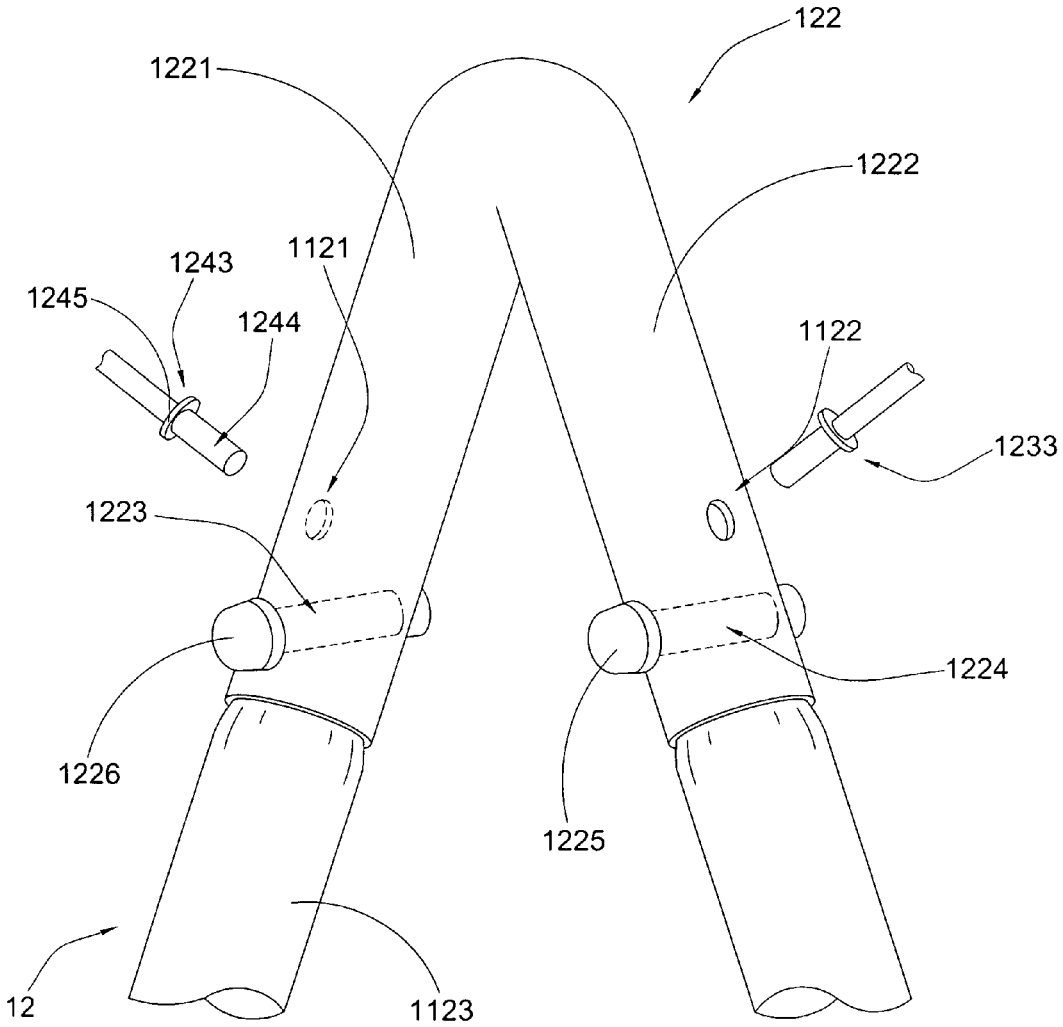
FIG. 6 is a schematic diagram of a second connector of the first entertainment unit of the playground according to the above preferred embodiment of the present invention.
Figure 7:
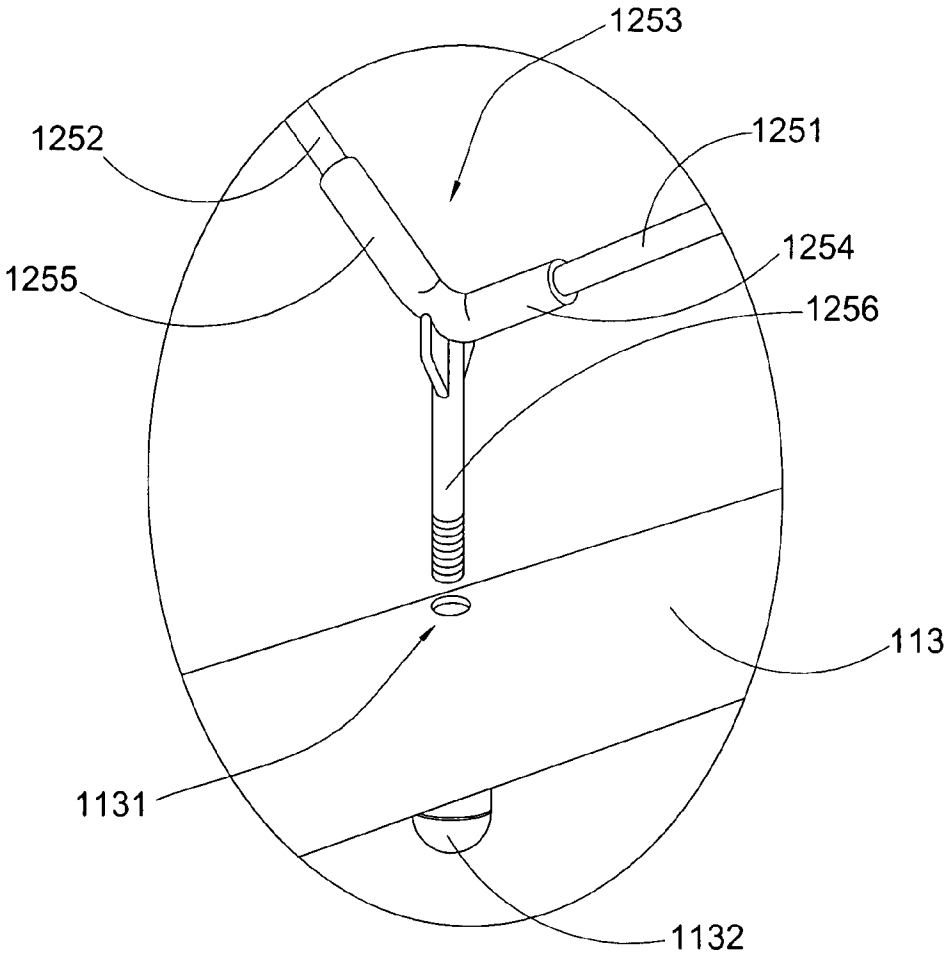
FIG. 7 is a schematic diagram of a reinforcing joint of the first entertainment unit of the playground according to the above preferred embodiment of the present invention.
Figure 8:
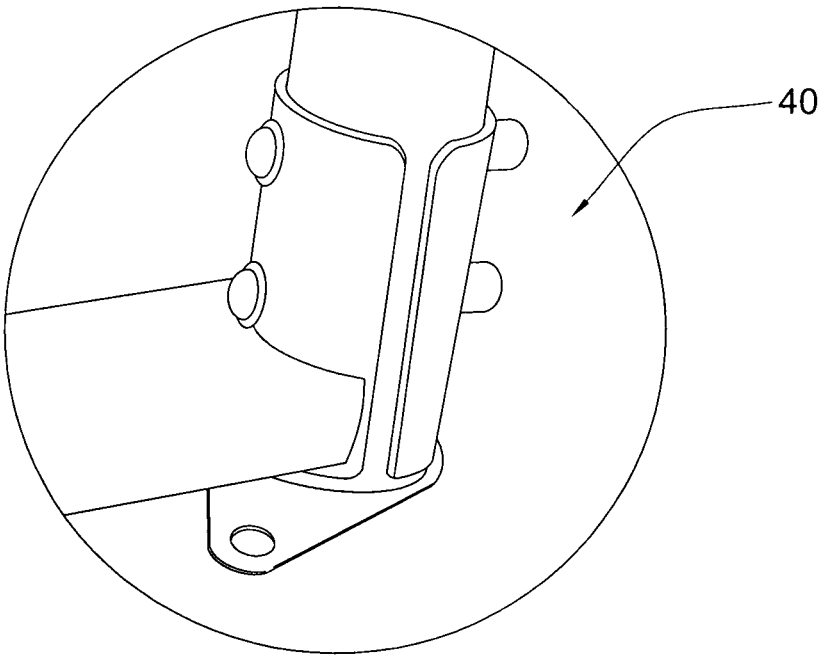
FIG. 8 is a schematic diagram of a mounting joint of the playground according to the above preferred embodiment of the present invention.

As shown in FIG. 6 of the drawings, each of the first connectors 1233 has a first body portion 1234 arranged to be inserted into the corresponding mounting slot 1111 (1121), and a first stopper portion 1235 transversely and radially extended from the first body portion 1234 to stop a further inward movement of the first body portion 1234 of the first connectors 1233. Similarly, as shown in FIG. 7 of the drawings, each of the second connectors 1243 has a second body portion 1244 arranged to be inserted into the corresponding mounting slot 1112 (1122), and a second stopper portion 1245 transversely and radially extended from the second body portion 1244 to stop a further inward movement of the second body portion 1244 of the second connectors 1243.

Furthermore, the first coupling joint 121 further comprises a first and a second coupler 1215, 1216 provided at the first and the second connecting slot 1213, 1214 respectively, wherein the first legs 1113 are adapted to detachably mounted to the first and the second joint body 1211, 1212 and selectively locked up by the first and the second coupler 1215, 1216 respectively.

Similarly, the second coupling joint 122 further comprises a third and a fourth coupler 1225, 1226 provided at the third and the fourth connecting slot 1223, 1224 respectively, wherein the second legs 1123 are adapted to detachably mounted to the third and the fourth joint body 1221, 1222 and selectively locked up by the third and the fourth coupler 1225, 1226 respectively.

The reinforcing frame 125 comprises a first and a second reinforcing member 1251, 1252 extended from the first frame member 123 and the second frame member 124 toward the supporting bar 113, and a reinforcing joint 1253 provided at an intersection of the first reinforcing member 1251, the second reinforcing member 1252 and the supporting bar 113 so as to detachably connect the first reinforcing member 1251, the second reinforcing member 1252 with the supporting bar 113.

Thus, the reinforcing joint 1253 has first through third joint members 1254, 1255, 1256 each having one end portion connected with the first reinforcing member 1251, the second reinforcing member 1252, and the supporting bar 113 respectively, and another end portion connected with each other. The supporting bar 113 further has a supporter slot 1131 formed at a mid portion thereof, wherein the third joint member 1256 is arranged to insert into the supporter slot 1131 and locked up by a securing connector 1132 so as to mount the first and the second reinforcing member 1251, 1252 on the supporting bar 113 through the reinforcing joint 1253.

The reinforcing frame 125 further comprises a first and a second fastening joint 1257, 1258 jointing the first reinforcing member 1251 with the first frame member 123, and joining the second reinforcing member 1252 with the second frame member 124 respectively. More specifically, the first fastening joint 1257 has a first tubular portion 12571 connected with the first frame member 123, and a first affixing portion 12572 extended from the first tubular portion 12571 and connected to the first reinforcing member 1251. Similarly, the second fastening joint 1258 has a second tubular portion 12581 connected with the second frame member 124, and a second affixing portion 12582 extended from the second tubular portion 12581 and connected to the second reinforcing member 1252.

As shown in FIG. 1 and FIG. 2 of the drawings, the first utility frame 11 can be attached by a first entertainment device such as the swing 13 and the training bar 14 so that people using the swing 13 and the training bar 14 are effectively shielded from sunlight.

Figure 2A:
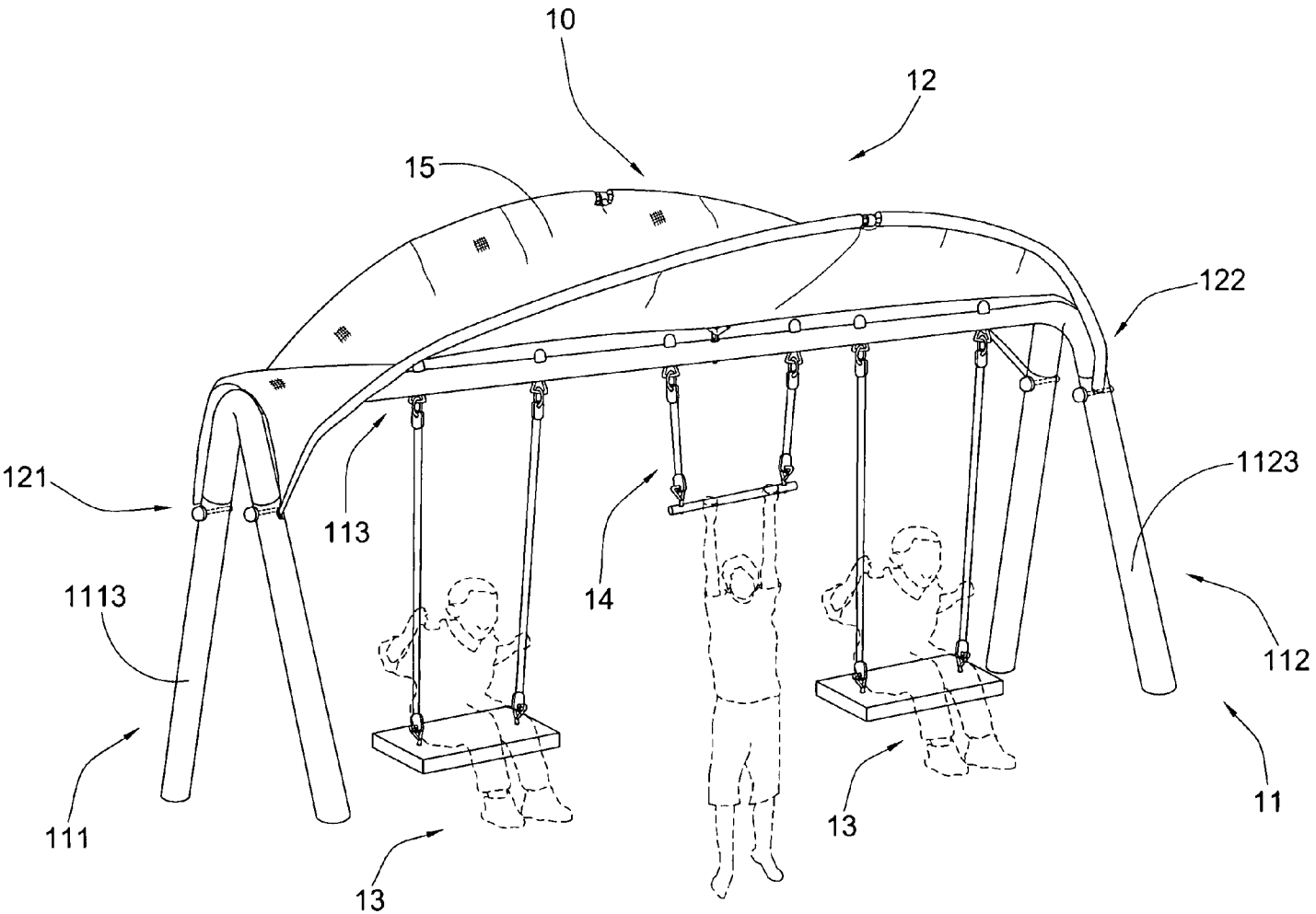
FIG. 2A and FIG. 2B are schematic diagrams of the two entertainment units according to the above preferred embodiment of the present invention.
Figure 2B:
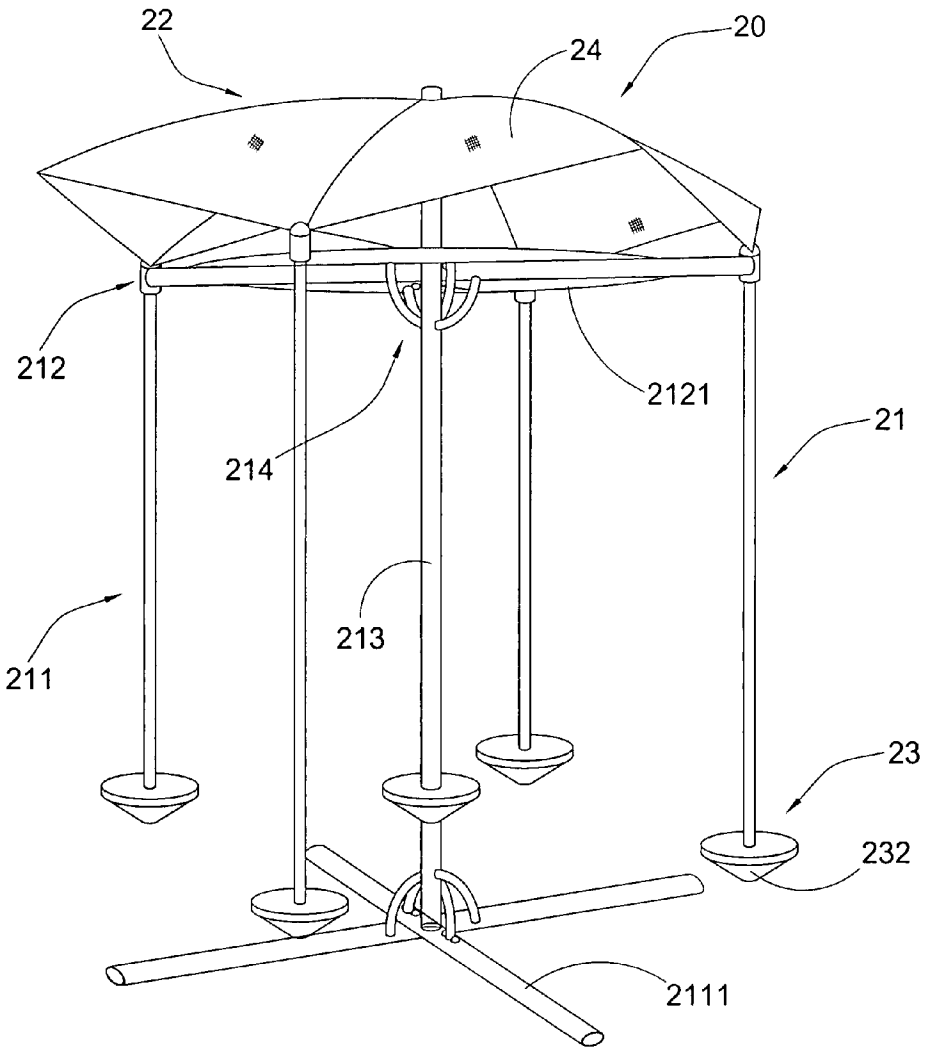
Figure 3:
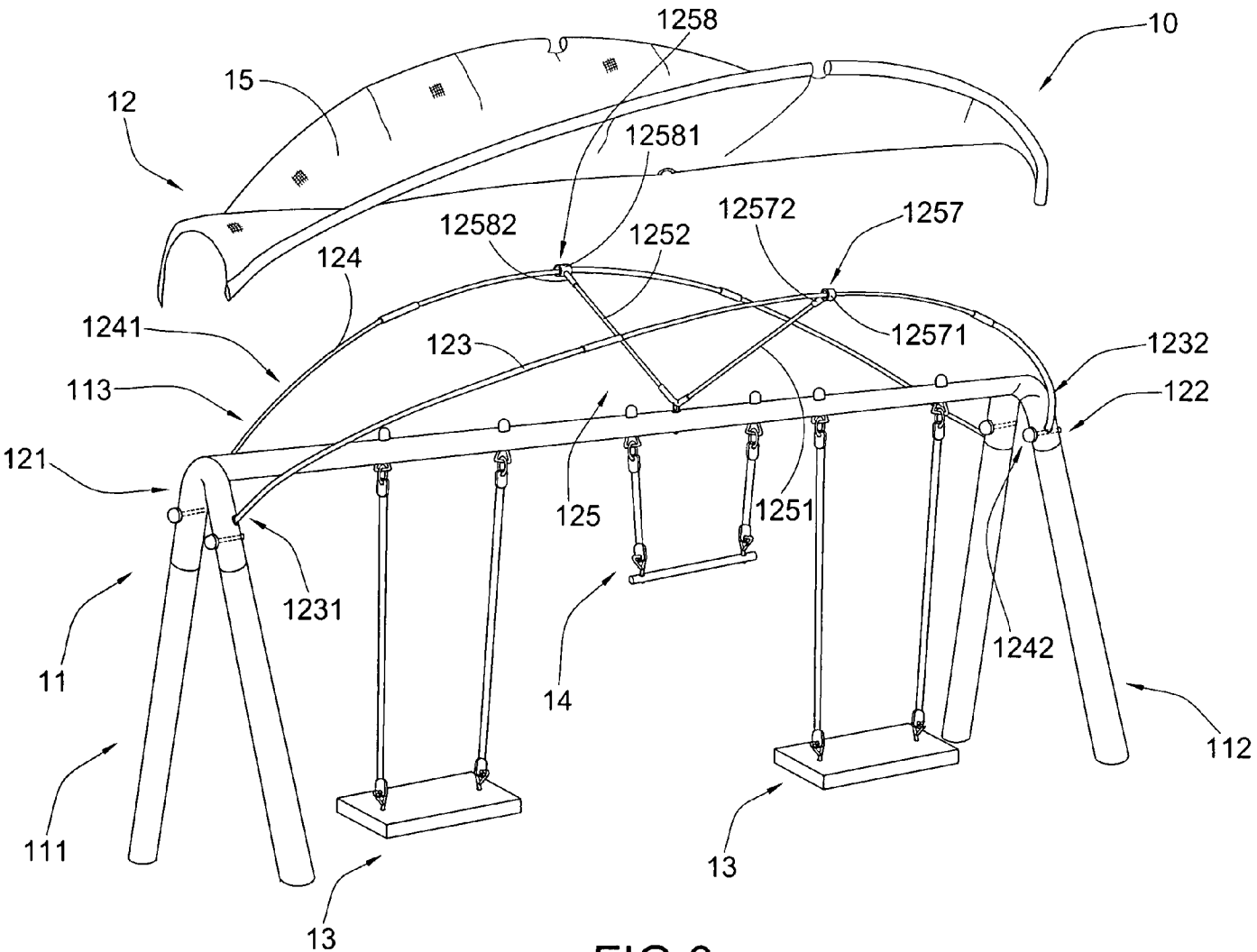
FIG. 3 is an exploded perspective view of the first entertainment unit according to the above preferred embodiment of the present invention.
Figure 4:
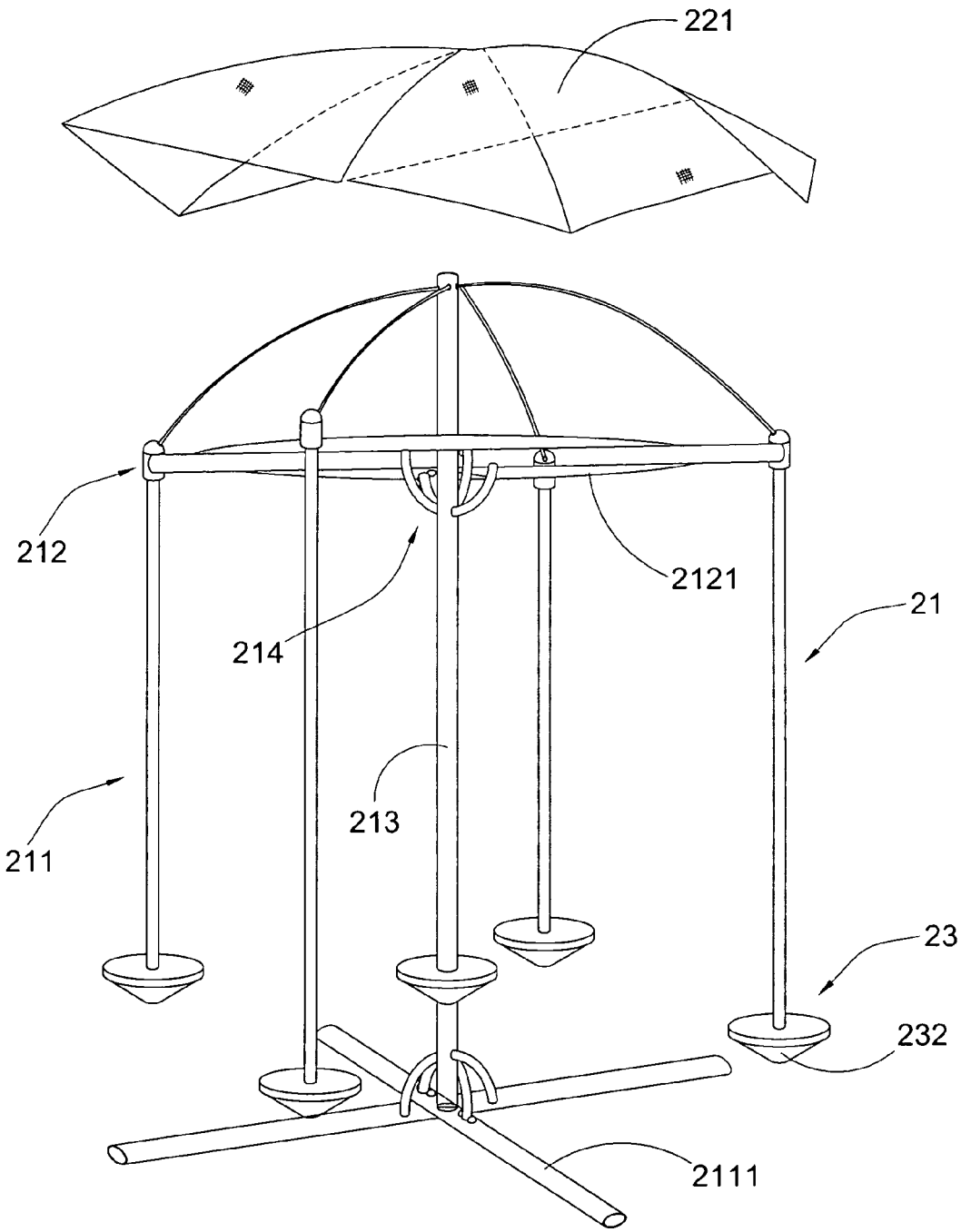
FIG. 4 is an exploded perspective view of the second entertainment unit according to the above preferred embodiment of the present invention.
Figure 5:
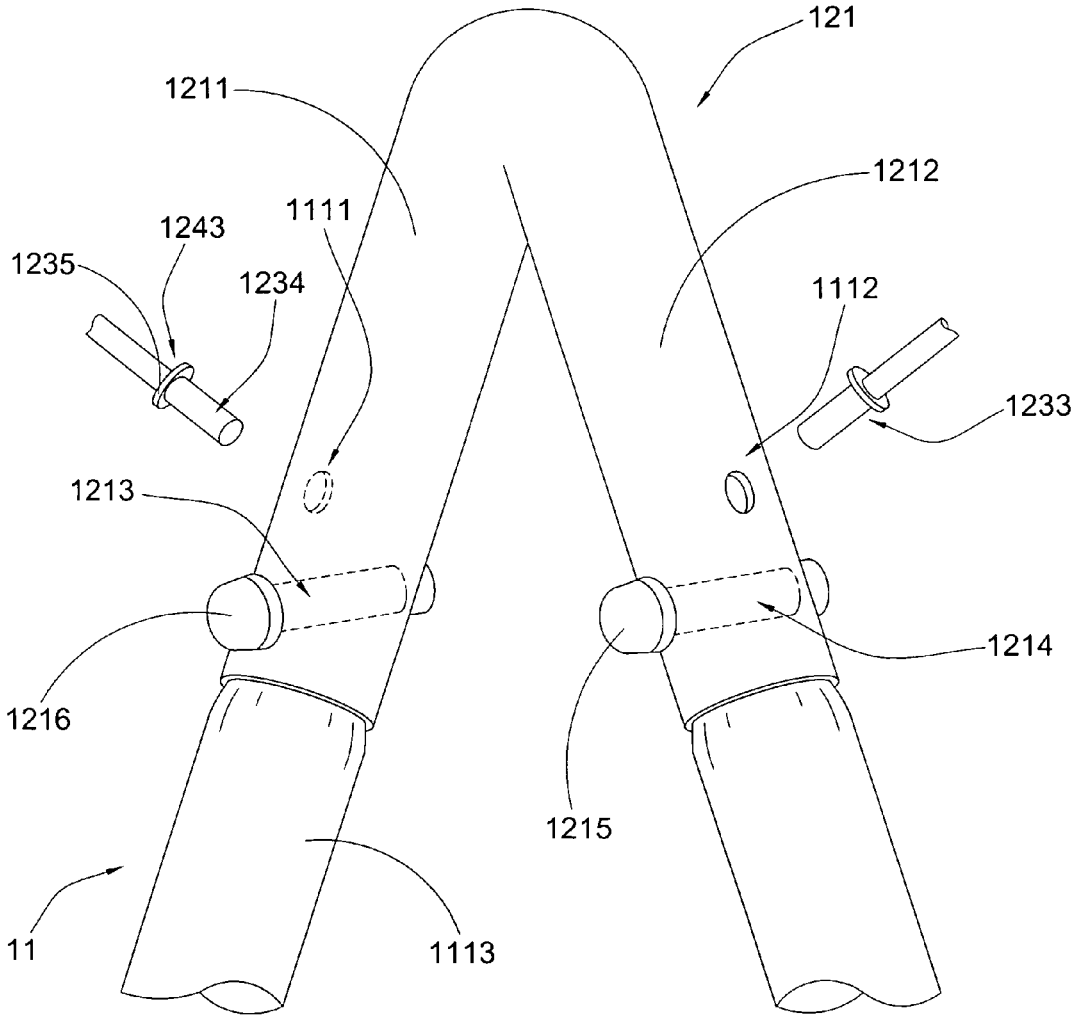
FIG. 5 is a schematic diagram of a first connector of the first entertainment unit of the playground according to the above preferred embodiment of the present invention.

Referring to FIG. 2B and FIG. 4 of the drawings, the second utility frame 21 of the second entertainment unit 20 comprises a lower supporting frame 211, an upper supporting frame 212, and a supporting shaft 213 extended between the lower supporting frame 211 and the upper supporting frame 212. The lower supporting frame 211 comprises a plurality of elongated supporters 2111 extended at an inclination with respect to each other so as to allow the second utility frame 21 to stand on a ground surface.

The upper supporting frame 212 comprises a plurality of supporting arms 2121 extended from the supporting shaft 213 to support a second entertainment device. In this preferred embodiment, the second entertainment device comprises a plurality of space walking apparatuses 23 supported by the supporting arms 2121 for allowing a user to stand thereon for performing funny exercises.

Each of the space walking apparatuses 23 comprises a holding shaft 231 and a supporting base 232 provided at a lower end of the holding shaft 231, wherein an upper end thereof is pivotally connected to the corresponding supporting arm 2121 in such a manner that a user is able to stand on the supporting base 232 and hold on the holding shaft 231 for initiating a pivotal movement about the corresponding supporting arm 2121.

The second utility frame 21 further comprises a rotatable joint 214 provided at a top portion of the supporting shaft 213 in such a manner that the upper supporting frame 212 is arranged to rotate about the supporting shaft 213. Thus, each of the space walking apparatuses 23 (in additional to the pivotal motion described above) can also be rotated about the supporting shaft 213.

The second shading apparatus 22 comprises a plurality of shading members 221 each of which extends between two outer ends of two opposite supporting arms 2121 so as to form a shading platform for the second entertainment unit 20, wherein the second entertainment unit 20 further comprises a second shading fabric 24 detachably mounted on this shading platform for substantially shading the space walking apparatuses 23.

The playground of the present invention further comprises at least one mounting joint 40 which is arranged to couple the first utility frame 11 with the second utility frame 12 so as to structurally connect the first entertainment unit 10 with the second entertainment unit 20. Note that the purpose of the mounting joint 40 is to connect each of the entertainment units with the adjacent entertainment unit so that the entertainment units of the playground are connected to form an integral structure.

It is worth mentioning that the playground of the present invention can comprise many entertainment units. Thus, when more than two entertainment units are involved, each of the entertainment units is connected to the adjacent entertainment unit by the mounting joint 40 for enhancing the structural integrity of all of the entertainment units.

Furthermore, the playground may have some auxiliary units which are not shielded but nevertheless provided for enhanced entertainment effect. The auxiliary units are structurally attached to the corresponding entertainment units so that people playing in that entertainment unit may have more entertaining options. For example, as shown in FIG. 1 of the drawings, the first entertainment unit 10 further comprises a first auxiliary unit 16 which is embodied as a slide attached onto the first utility frame 11. More specifically, the first auxiliary unit 16 comprises a slider frame 161 attached to the first leg frame 111 and is positioned side-by-side with the first utility frame 11, and a sliding panel 162 mounted on the slider frame 161 for allowing a person to slide thereon. Thus, the sliding panel 162 is curved in cross section having an upper end mounted to the slider frame 161, and another end supported on the ground so as to allow the sliding panel 162 to be inclinedly supported by the slider frame 11.

In order to further enhance the features of the present invention, the first entertainment unit 10 further comprises a second auxiliary unit 17 attached to the first auxiliary unit 16 for providing a predetermined kind of entertainment function. In this preferred embodiment, the second auxiliary unit 17 comprises a jumping frame 171 and a jumper element 172 mounted in the jumping frame 161 for allowing a user to jump thereon. The jumper element 172 has a predetermined elasticity so that the user is allowed to jump very high when playing on the jumping frame 171.

It is important to mention that the entertainment units and the auxiliary units may be embodied as performing different functions so as to support different entertainment activities. The above mentioned structures are merely exemplary and the manufacturer of the present invention is free to construct any combination of the above entertainment units and auxiliary units.

Figure 9A:
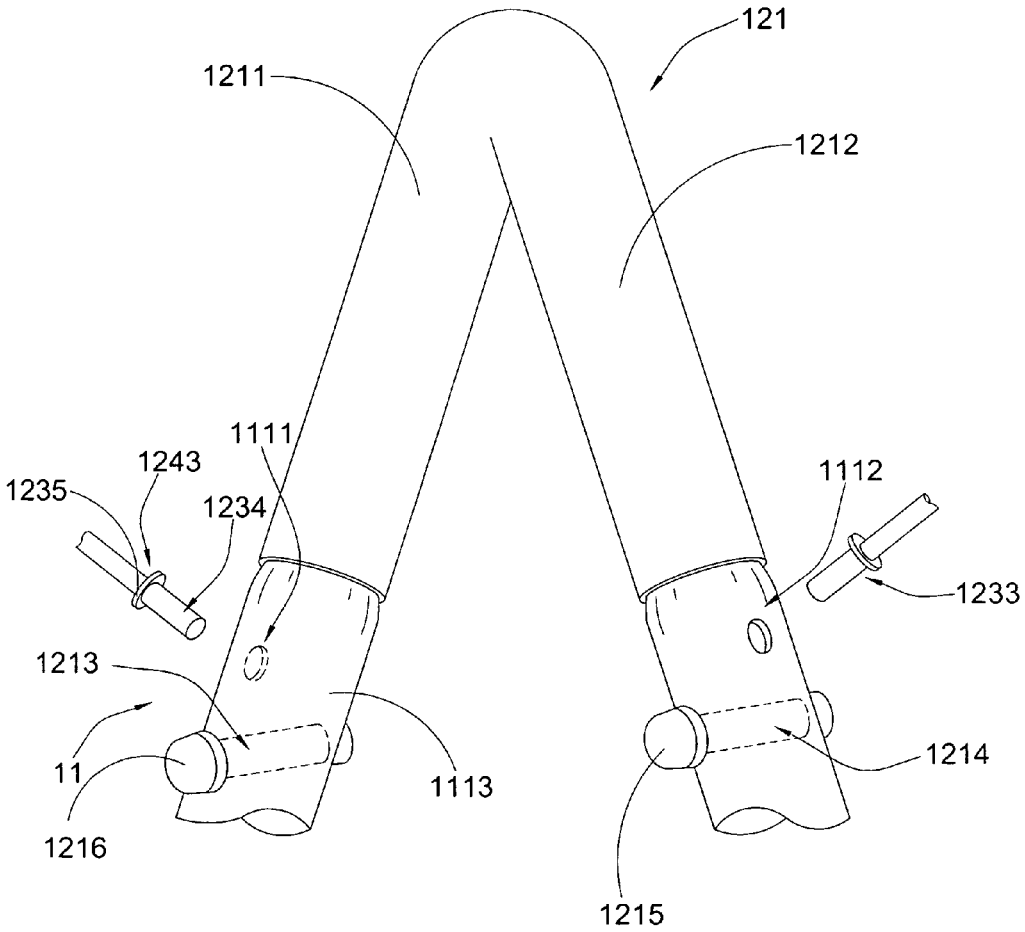
FIG. 9A and FIG. 9B are schematic diagrams of an alternative mode of the playground according to the above preferred embodiment of the present invention.
Figure 9B:
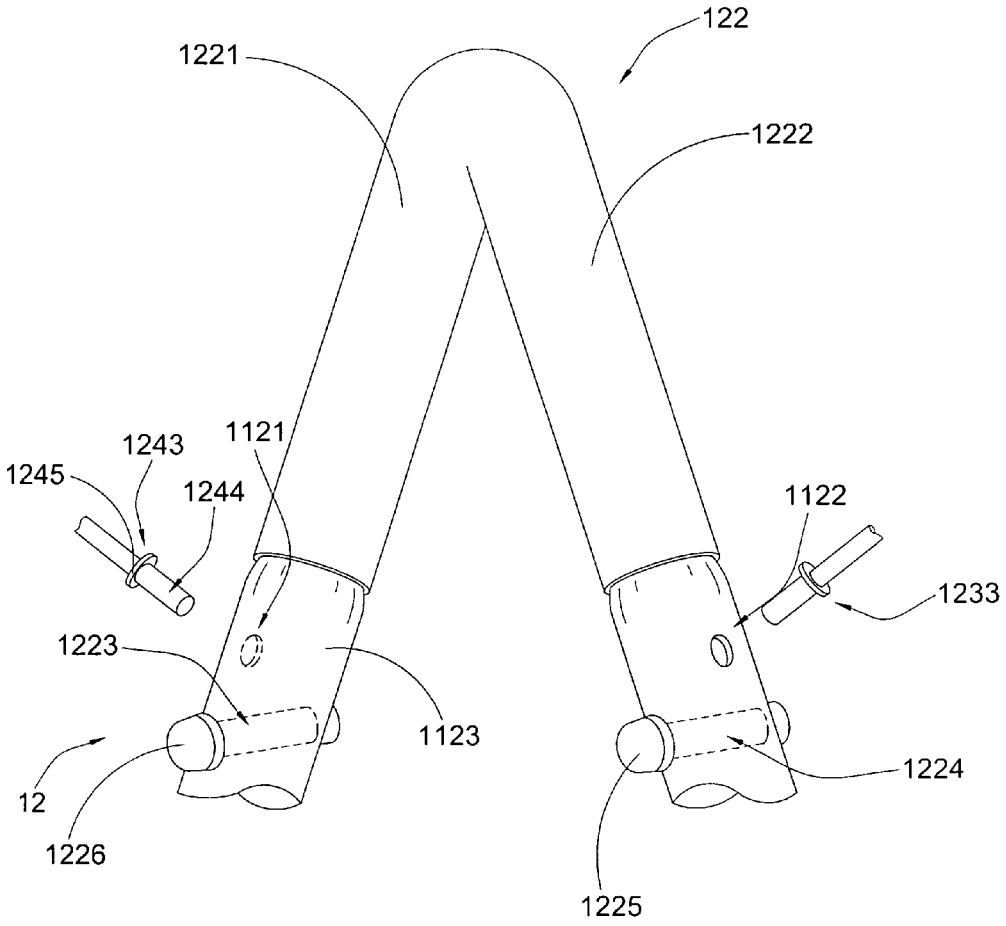

Referring to FIG. 9A and FIG. 9B of the drawings, an alternative mode of the outdoor playground according to the preferred embodiment of the present invention is illustrated. The alternative mode is similar to the preferred embodiment except the positions of the first through fourth mounting slot 1111', 1112', 1121', 1122'. In the alternative mode, the first through second mounting slot 1111', 1112' are formed on the first legs 1113' while the third through fourth mounting slot 1121', 1122' are formed on the second legs 1123'. Thus, the first and the second frame member 123', 124' are arranged to connect to the first legs 1113' and the second legs 1123' through the first through fourth connecting slot 1111', 1112', 1121', 1122'.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An outdoor playground, comprising:

a first and a second entertainment units connected with each other, wherein said first entertainment unit comprises:

a first utility frame configured to allow a predetermine entertainment function to be carried out by said first utility frame, wherein said first utility frame comprises a first and a second leg frame and a supporting bar extended between said first and said second leg frame, wherein said first leg frame has a first and a second mounting slot, while said second leg frame has a third and a fourth mounting slot; and a first shading apparatus detachably mounted on said first utility frame for effectively shielding said first utility frame so as to allow said entertainment function to be carried out under shading, wherein said first shading apparatus comprises a first and a second coupling joints each having a V-shaped cross section and being detachably coupled with two ends of said supporting bar respectively;

wherein said second entertainment unit comprises:

a second utility frame configured to allow a predetermine entertainment function to be carried out by said second utility frame; and a second shading apparatus detachably mounted on said second utility frame for effectively shielding said second utility frame so as to allow said entertainment function to be carried out under shading, whereby said first and said second entertainment units are arranged to act as entertainment facilities as outdoor playground to users who are substantially shaded from sunlight by said first and said second shading frame.

2. An outdoor playground, comprising:

a first and a second entertainment units connected with each other, wherein said first entertainment unit comprises:

a first utility frame configured to allow a predetermine entertainment function to be carried out by said first utility frame; and a first shading apparatus detachably mounted on said first utility frame for effectively shielding said first utility frame so as to allow said entertainment function to be carried out under shading;

wherein said second entertainment unit comprises:

a second utility frame configured to allow a predetermine entertainment function to be carried out by said second utility frame, wherein said second utility frame of said second entertainment unit comprises a lower supporting frame, an upper supporting frame, and a supporting shaft extended between said lower supporting frame and said upper supporting frame, wherein said lower supporting frame comprises a plurality of elongated supporters extended at an inclination with respect to each other so as to allow said second utility frame to stand on a ground surface, wherein said upper supporting frame comprises a plurality of supporting arms extended from said supporting shaft to support a second entertainment device, wherein said second entertainment device comprises a plurality of space walking apparatuses supported by said supporting arms for allowing a user to stand thereon for performing exercises, wherein each of said space walking apparatuses comprises a holding shaft and a supporting base provided at a lower end of said holding shaft, wherein an upper end thereof is pivotally connected to said corresponding supporting arm in such a manner that a user is able to stand on said supporting base and hold on said holding shaft for initiating a pivotal movement about said corresponding supporting arm; and a second shading apparatus detachably mounted on said second utility frame for effectively shielding said second utility frame so as to allow said entertainment function to be carried out under shading, whereby said first and said second entertainment units are arranged to act as entertainment facilities as outdoor playground to users who are substantially shaded from sunlight by said first and said second shading frame.

3. The outdoor playground, as recited in claim 2, wherein said second utility frame further comprises a rotatable joint provided at a top portion of said supporting shaft in such a manner that said upper supporting frame is arranged to rotate about said supporting shaft.

4. The outdoor playground, as recited in claim 3, wherein said second shading apparatus comprises a plurality of shading members each of which extends between two outer ends of two opposite supporting arms so as to form a shading platform for said second entertainment unit, wherein said second entertainment unit further comprises a second shading fabric detachably mounted on said shading platform for substantially shading said space walking apparatuses.

5. The outdoor playground, as recited in claim 4, further comprising at least one mounting joint which is arranged to couple said first utility frame with said second utility frame so as to structurally connect said first entertainment unit with said second entertainment unit.

6. The outdoor playground, as recited in claim 5, wherein said first entertainment unit further comprises a first auxiliary unit which is embodied as a slide attached onto said first utility frame.

7. The outdoor playground, as recited in claim 6, wherein said first entertainment unit further comprises a second auxiliary unit attached to said first auxiliary unit, wherein said second auxiliary unit comprises a jumping frame and a jumper element mounted in said jumping frame for allowing a user to jump thereon.

8. An outdoor playground, comprising:

a first and a second entertainment units connected with each other, wherein said first entertainment unit comprises:

a first utility frame configured to allow a predetermine entertainment function to be carried out by said first utility frame, wherein said first utility frame comprises a first and a second leg frame and a supporting bar extended between said first and second leg frame, wherein said first leg frame has a first and a second mounting slot, while said second leg frame has a third and a fourth mounting slot, wherein said first leg frame comprises a plurality of first legs inclinedly extended from said ground surface toward said supporting bar, wherein said first and said second mounting slot are formed on said first legs respectively, wherein said second leg fame comprises a plurality of second legs inclinedly extended from said ground surface toward said supporting bar; and a first shading apparatus detachably mounted on said first utility frame for effectively shielding said first utility frame so as to allow said entertainment function to be carried out under shading, wherein said first shading apparatus comprises a first and a second coupling joints each having a V-shaped cross section and is detachably coupled with two ends of said supporting bar respectively, wherein said first shading apparatus further comprises a first frame member having two ends detachably coupled with said first and said third mounting slot of said first leg frame and said second leg frame respectively, and a second frame member having two ends detachably coupled with said second mounting slot and said fourth mounting slot of said first and said second leg frame respectively, wherein said first shading apparatus further comprises a reinforcing frame extended between said first and second frame member and said supporting bar to form a support platform by said first and second frame member and said reinforcing frame, wherein said first entertainment unit further comprises a first shading fabric detachably mounted on said support platform for shading adverse weather condition in an area underneath said shading fabric, wherein said first coupling joint is mounted between said supporting bar and said first legs and said second coupling joint is mounted between said supporting bar and said second legs, wherein said third and said fourth mounting slot are formed on said second legs respectively, wherein said first frame member further has a plurality of first connectors formed at two ends thereof, wherein said first connectors are arranged to detachably inserted into said first mounting slot and said third mounting slot respectively so as to extend across said first leg frame and said second leg frame in a longitudinal direction of said first entertainment unit, wherein said second frame member has a plurality of second connectors formed at two ends thereof, wherein said second connectors are arranged to detachably inserted into said second mounting slot and said fourth mounting slot respectively so as to extend across said first leg frame and said second leg frame, wherein said reinforcing frame comprises a first and a second reinforcing member extended from said first frame member and said second frame member toward said supporting bar, and a reinforcing joint provided at an intersection of said first reinforcing member, said second reinforcing member and said supporting bar so as to detachably connect said first reinforcing member, said second reinforcing member with said supporting bar;

wherein said second entertainment unit comprises:

a second utility frame configured to allow a predetermine entertainment function to be carried out by said second utility frame, wherein said second utility frame of said second entertainment unit comprises a lower supporting frame, an upper supporting frame, and a supporting shaft extended between said lower supporting frame and said upper supporting frame, wherein said lower supporting frame comprises a plurality of elongated supporters extended at an inclination with respect to each other so as to allow said second utility frame to stand on a ground surface, wherein said upper supporting frame comprises a plurality of supporting arms extended from said supporting shaft to support a second entertainment device, wherein said second entertainment device comprises a plurality of space walking apparatuses supported by said supporting arms for allowing a user to stand thereon for performing exercises, wherein each of said space walking apparatuses comprises a holding shaft and a supporting base provided at a lower end of said holding shaft, wherein an upper end thereof is pivotally connected to said corresponding supporting arm in such a manner that a user is able to stand on said supporting base and hold on said holding shaft for initiating a pivotal movement about said corresponding supporting arm; and a second shading apparatus detachably mounted on said second utility frame for effectively shielding said second utility frame so as to allow said entertainment function to be carried out under shading, whereby said first and said second entertainment units are arranged to act as entertainment facilities as outdoor playground to users who are substantially shaded from sunlight by said first and said second shading frame.

9. The outdoor playground, as recited in claim 8, wherein said second utility frame further comprises a rotatable joint provided at a top portion of said supporting shaft in such a manner that said upper supporting frame is arranged to rotate about said supporting shaft.

10. The outdoor playground, as recited in claim 9, wherein said second shading apparatus comprises a plurality of shading members each of which extends between two outer ends of two opposite supporting arms so as to form a shading platform for said second entertainment unit, wherein said second entertainment unit further comprises a second shading fabric detachably mounted on said shading platform for substantially shading said space walking apparatuses.

11. The outdoor playground, as recited in claim 10, further comprising at least one mounting joint which is arranged to couple said first utility frame with said second utility frame so as to structurally connect said first entertainment unit with said second entertainment unit.

12. The outdoor playground, as recited in claim 11, wherein said first entertainment unit further comprises a first auxiliary unit which is embodied as a slide attached onto said first utility frame.

13. The outdoor playground, as recited in claim 12, wherein said first entertainment unit further comprises a second auxiliary unit attached to said first auxiliary unit, wherein said second auxiliary unit comprises a jumping frame and a jumper element mounted in said jumping frame for allowing a user to jump thereon.

* * * * *